United States Patent [19]

Fleischhacker

[11] 4,162,815

[45] Jul. 31, 1979

[54] MEANS FOR CABLE SECTION AND EQUIPMENT TRANSFER WITHOUT SERVICE INTERRUPTION

[75] Inventor: James E. Fleischhacker, Winston-Salem, N.C.

[73] Assignee: AMP Incorporated, Harrisburg, Pa.

[21] Appl. No.: 868,597

[22] Filed: Jan. 11, 1978

Related U.S. Application Data

[63] Continuation-in-part of Ser. No. 783,127, Mar. 31, 1977, which is a continuation-in-part of Ser. No. 630,589, Nov. 10, 1975, abandoned.

[51] Int. Cl.[2] ..... H01R 13/00

[52] U.S. Cl. ..... 339/19; 200/51 R; 307/147; 324/126; 339/29 R; 339/49 R; 339/147 R

[58] Field of Search ..... 339/19, 28, 47–49, 339/147, 29, 166, 222, 97–99; 307/147; 200/51 R; 324/74, 126

[56] References Cited

U.S. PATENT DOCUMENTS

| | | | |
|---|---|---|---|
| Re. 18,419 | 4/1932 | Sachs | 324/74 |
| 2,802,083 | 8/1957 | Lapeyre | 339/99 R |
| 2,977,562 | 3/1961 | Benson | 339/166 R |
| 3,054,024 | 9/1962 | Dillen et al. | 338/166 R |

*Primary Examiner*—Joseph H. McGlynn

[57] ABSTRACT

Stackable connectors joining successive lengths of multiwire cable allow versatility in connecting various sections of cable together, and entering the cable to make modifications and equipment substitutions.

4 Claims, 29 Drawing Figures

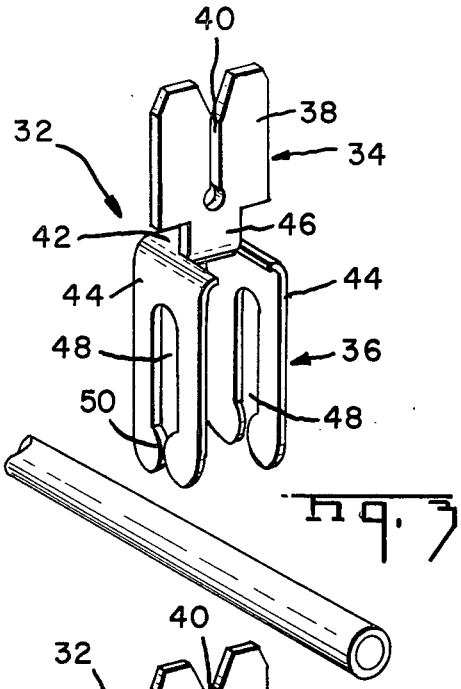
Fig. 3
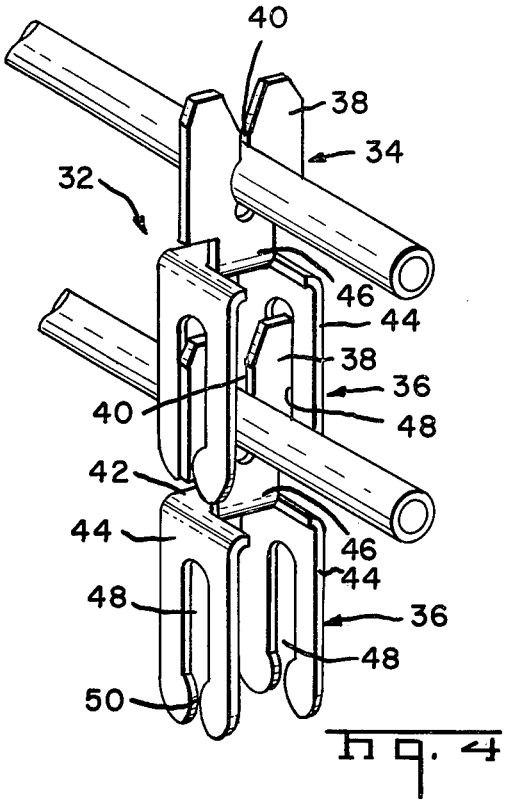
Fig. 4
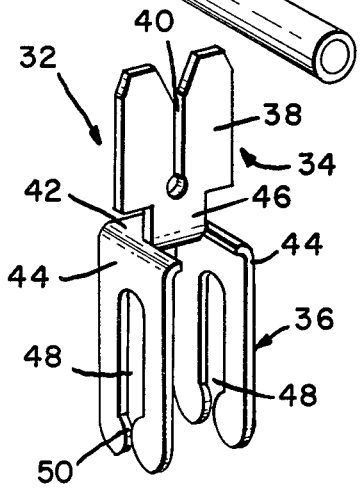
Fig. 5
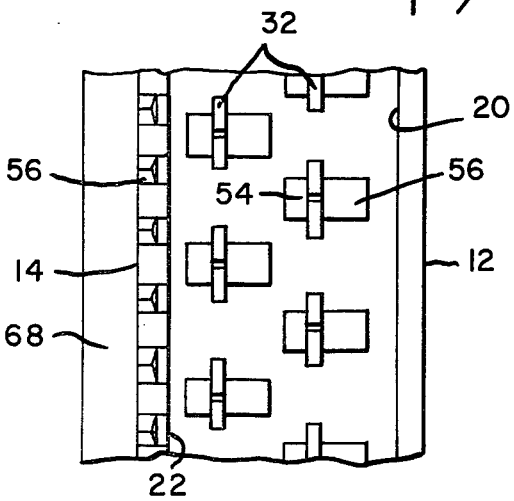
Fig. 6
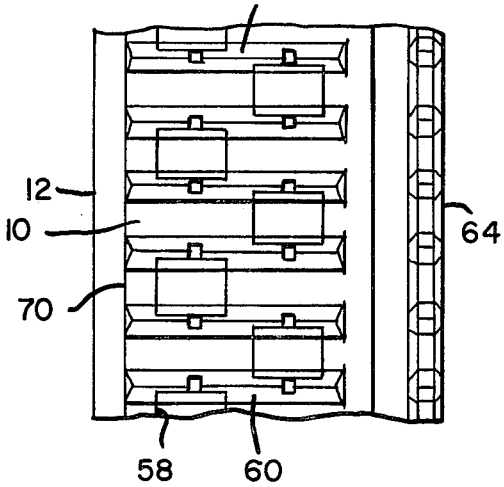

MEANS FOR CABLE SECTION AND EQUIPMENT TRANSFER WITHOUT SERVICE INTERRUPTION

RELATED APPLICATIONS

This is a continuation-in-part of application Ser. No. 783,127, filed Mar. 31, 1977; which, in turn is a continuation-in-part of application Ser. No. 630,589, filed Nov. 10, 1975, now abandoned.

BACKGROUND OF THE INVENTION

An everyday task which is carried out with great frequency in the telephone industry is that of connecting the individual wires in a first bundle of wires to the individual wires in a second bundle of wires. For example, communications cables comprise one or more bundles of wires, each bundle containing twenty-five pairs of wires. When a telephone cable line is installed, the cable is supplied in predetermined lengths and the end of each cable section in the line must be spliced to the end of the next section which means that all of the individual wires in the cable must be spliced to each other in individual connections. Splicing operations must also be carried out whenever new equipment, such as a switch system or a load coil system, is installed.

Originally, these splicing operations were carried out by wire twist splicing or by means of crimpable electrical connecting devices, one crimpable connecting device serving only to connect a single wire to a single wire in the two cable ends. More recently, conductor splicing operations have been carried out by modular multi-contact connectors as shown, for example, in U.S. Pat. Nos. 3,772,635, 3,708,779, 3,239,796, and 3,611,522 and modular connectors are now widely used in the telephone industry. In general, the preferred forms of modular connectors of the types described in the foregoing patents comprise a connector module which has contact terminals therein which are adapted to receive the wires which are to be connected, the terminals having wire-receiving slots at both of their ends. These connectors also have some provision for making tap connections to a cable, as by the use of a special tap module which is coupled with, or plugged onto the main connector module in which the through wires are connected.

The presently available modules for cable splicing or bundle splicing operations have, at best, limited pluggability; that is, it is possible to make a tap connection to a cable by plugging a tap module into a main module but the pluggability of the modules used is limited, at best, to such tap applications.

The instant invention is directed to splicing operations which have the advantage of unlimited pluggability or mateability with identical or similar connector modules. This feature of unlimited pluggability is particularly desirable in the telephone industry for several reasons; for example, when changes are made in a telephone cable, the preexisting connections can be broken by merely unplugging two mated connector parts and the new equipment can be installed by merely mating the unplugged parts with complementary or identical connector parts on cables extending from the new equipment. Under many circumstances, the changes which may be required to a telephone system can be effected without interrupting the service as by the use of jumper cables during changes to the system.

OBJECTS

An object of the present invention is to provide a method for adding or removing sections of a transmission cable without interrupting service over said cable.

Another object is to provide for addition of electrical equipment serially in a transmission cable without interrupting service over said transmission cable. Another object is to provide for substitution of electronic switching system for a cross bar switch in a transmission cable without service interruption of said cable. Another object of the present invention is to provide a method for entering a transmission cable made up of sections serially connected by mated pairs of connectors and substituting electrical equipment or another cable section for a section of the transmission cable without service interruption.

These and other objects of the invention are achieved in preferred embodiments thereof, which are briefly described in the foregoing abstract, which are described in detail below, and which are shown in the accompanying drawing in which:

FIG. 3 is a perspective view of two contact terminals of the type used in the connector body of FIG. 1.

FIG. 4 is a view simliar to FIG. 3 but showing wires connected to the terminals and the terminals mated to each other.

FIG. 5 and FIG. 6 are views taken along the lines 5—5 and 6—6 of FIG. 2.

Figure 1:
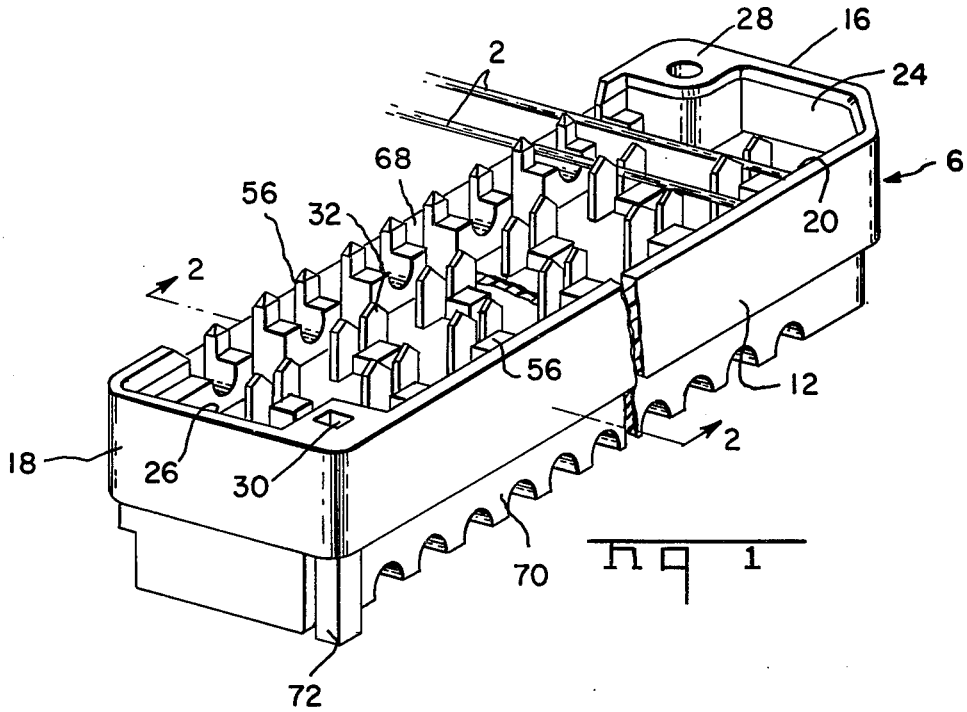
FIG. 1 is a perspective view of a preferred form of connector body for use in accordance with the invention.

The connection system for use in accordance with the invention comprises a connector body 6, FIGS. 1 and 2, which is intended to be installed on the ends of wires 2 in a bundle 4 and which can be used in conjunction with an identical connector body or with a base member 76 to connect the individual wires 2, for example, wires 2' in a bundle 4'. In the description which follows, connector body 6 will be described in detail and the other parts will subsequently be described.

Figure 2:
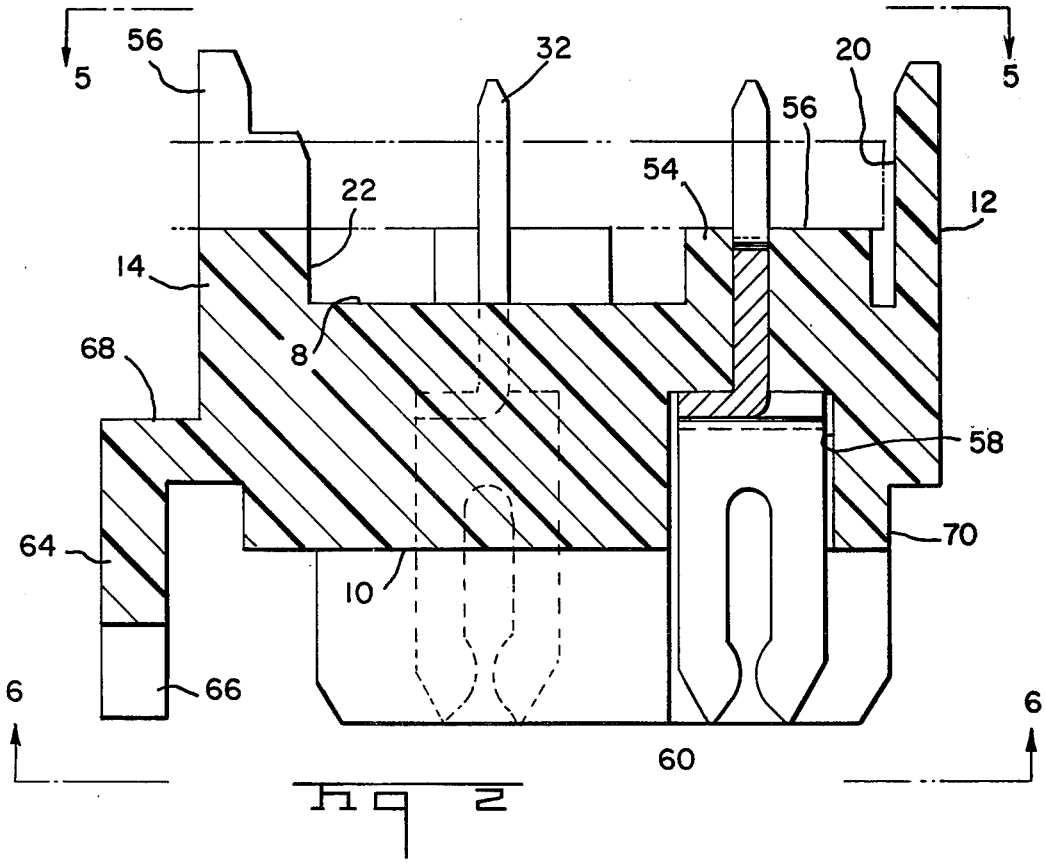
FIG. 2 is a cross sectional view taken along the lines 2—2 of FIG. 1.

The body 6 is generally prismatic having oppositely directed first and second faces 8, 10, external sidewalls 12, 14, and external end walls 16, 18. The face 8 is recessed as shown in FIG. 2 and is surrounded by internal sidewalls 20, 22 and internal end walls 24, 26. Integral bosses or heavy sections are provided in diametrically opposite corners as shown at 28, 30 on the face 8 and polarizing openings extend into the surfaces at these corners.

The body 6, and the cover member and base member described below, are of insulating material and are preferably manufactured by an injection molding process of a material such as glass-filled nylon or polyester.

A plurality of stamped and formed electrical contact terminals are mounted in, and extend through, the body 6 and are arranged in two parallel spaced-apart rows with the terminal of each row being offset from the terminals of the other row. Each terminal 32, FIG. 3, comprises a wire-receiving portion 34 and a receptacle portion 36, the wire-receiving portion comprising a plate-like member having a wire-receiving slot 40 extending inwardly from its upper end as viewed in the drawing. The width of the slot 40 is such that the opposed edges of the slot will displace the insulation of a wire during movement of the wire into the slot and establish electrical contact with the conducting core of the wire.

The receptacle portion 36 is U-shaped in cross section and comprises a web 42 and sidewalls 44. The wire-receiving portion 34 is connected to the web 42 by means of a reduced width neck 46. The sidewalls 44 have receptacle slots 48 extending upwardly from their lower ends and the entry portions 50 of the slots are constricted as shown so that when the wire-receiving portion 34 of the lower terminal shown in FIG. 3 is moved upwardly to the position of FIG. 4, the constricted contact portions 50 will engage the surface of the lower terminal and establish electrical contact. It will be noted that the wire-receiving portion 34 of each terminal defines a plane which intersects the parallel planes defined by the receptacle sidewalls 44. It should also be noted that the width of the plate-like portion 38 is greater than the distance between the sidewalls so that a portion of the wire-receiving portion 34 projects beyond the outwardly facing surfaces of the sidewalls of a mated terminal as shown in FIG. 4.

The terminals 32 are assembled to the body member 6 by inserting the wire-receiving portions 34 of the terminals through openings which extend between the faces 8, 10 so that the upper ends of the wire-receiving portions project above the face 8 and above the upper surfaces 56 of bosses 54 which are provided at the locations of the terminals on the face 8. These bosses serve to support the wire-receiving portions of the terminals against bending and the upper surface 56 of each boss serves as a wire stop when the wires are inserted into the slots 40 of the terminals. The side 14 of the body 6 constitutes a wire-receiving side and is provided with spaced-apart notches 56, each notch being in alignment with the slot 40 in one of the terminals 32 as shown in FIG. 2.

The receptacle portions 36 of the terminals are received in recesses 58 which extend inwardly from the second side 10 of the connector body. Transverse barriers 60 extend across the face 10 and separate adjacent terminals from each other as shown in FIG. 6. The recesses 56 have shallow grooves 62 on opposite surfaces to provide clearance for the projecting edge portions of the wire-receiving portion 38 of a mated terminals when the body 6 is mated with an identical body 6' (FIG. 7) or with a base member 76 which is described below.

In order to provide a strain relief for the wires, a depending flange 64 extends downwardly on the left hand side of the body as viewed in FIG. 2 and is offset from the side 14 by a connecting section 68. This flange is provided with spaced-apart notches 66 on its lower edge which are located such that they will be in registry with the notches 56 of a connector body plugged against the face 10 as shown also in FIG. 7. Since the notches 66 and the notches 56 of the adjacent connector body are offset from each other, a slight kink is produced in the wire 2 and the kink prevents the transmission of an excessive tensile pull on the wire to the electrical connection between the wire and the terminals.

The face 8 and the internal sidewalls and end walls 20, 22, 24, 26 are complementary to the face 10 so that the connector body 6 can be plugged at either of its faces to an identical connector and it can also be plugged at its lower face 10 to a base member 76 which is described below. Thus the sidewall 12 is recessed as shown at 70 so that the sidewall of the lower connector body 6' in FIG. 7 will be received against the recessed surface and the flange 64 is outwardly offset so that it will be spaced from the sidewall 14' of the lower connector 6'. A square polarizing pin 72 is provided in one of the corners of the body and a circular pin (not shown) is provided at the opposite corner for entry into the square and circular openings in the corners 28, 30 of an identical connector.

Figure 7:
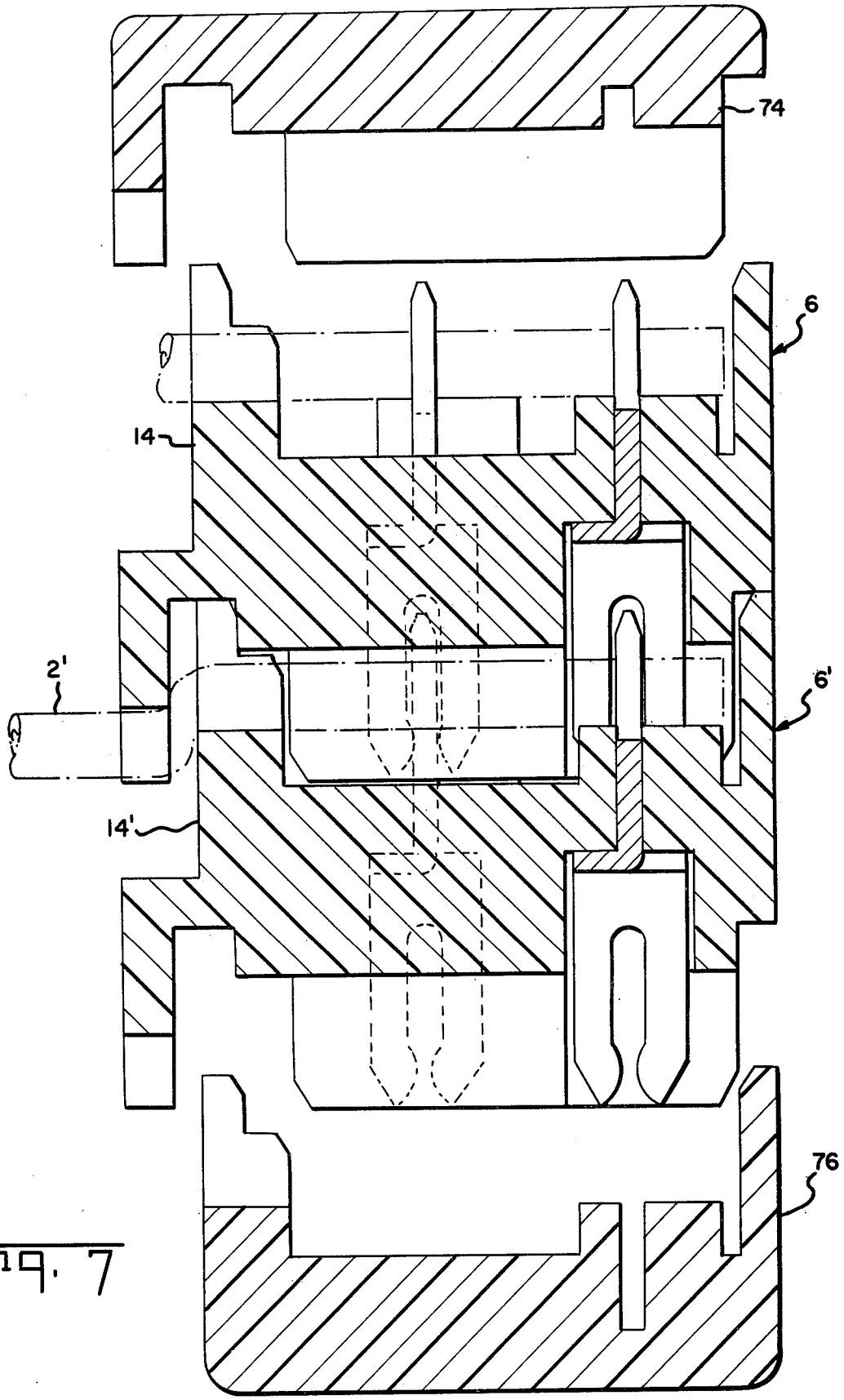
FIG. 7 is a cross sectional view showing two connector bodies mated with each other.

The wires 2 of a bundle 4 can be connected to the wire-receiving portions 34 of the terminals by the use of a suitable insertion tool such as the insertion tool shown in U.S. Pat. No. 3,972,101 of the insertion tool shown in application Ser. No. 740,999 filed Nov. 11, 1976. As will be apparent from FIG. 7 and as is explained in detail below, the wires 2 of the bundle 4 can, therefore, be connected to the wires 2' of the bundle 4' by simply connecting the wires 2 to the terminals of the connector 6, connecting the wires 2' to the terminals and the connector 6', plugging the two connector bodies to each other. When a cable or bundle splice of the type shown in FIG. 7 is made, it is desirable to cover the upper surface of the body 6 with a cap member 74 and to assemble a base member 76 against the lower face 10 of the connector body 6'. The base member in FIG. 7 would not, however, be provided with terminals 98 as described below but would merely serve as a protective cover.

Figure 8:
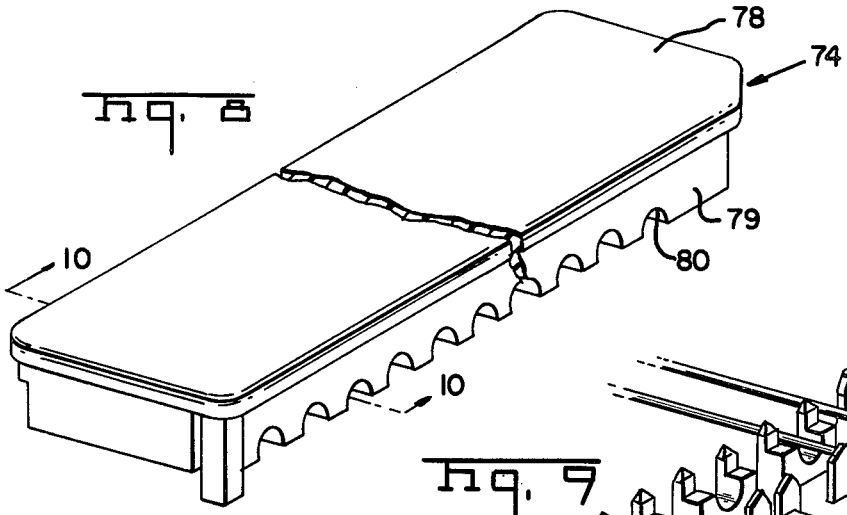
FIG. 8 is a perspective view of a cover member which is used with a connector body of the type shown in FIG. 1.
Figure 9:
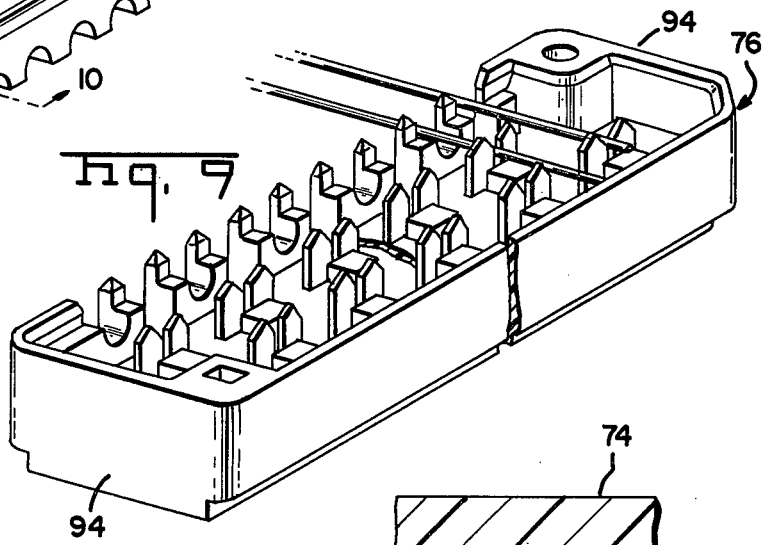
FIG. 9 is a perspective view of a base member which is used with a connector body of the type shown in FIG. 1.
Figure 11A:
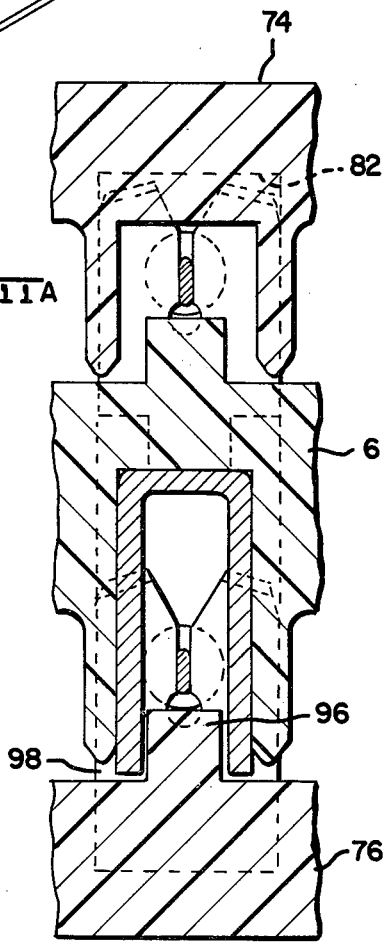
FIG. 11A is a view taken along the lines 11A—11A of FIG. 11.
Figure 10:
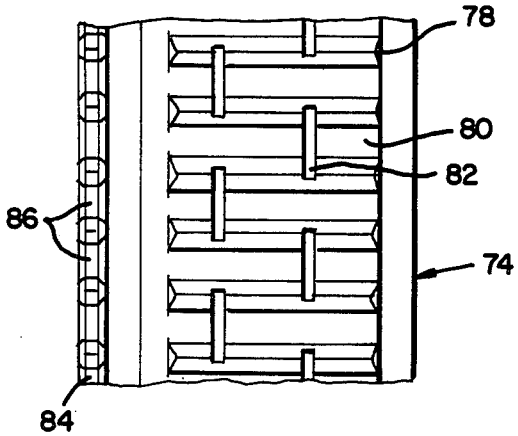
FIG. 10 is a view taken along the lines 10—10 of FIG. 8.
Figure 11:
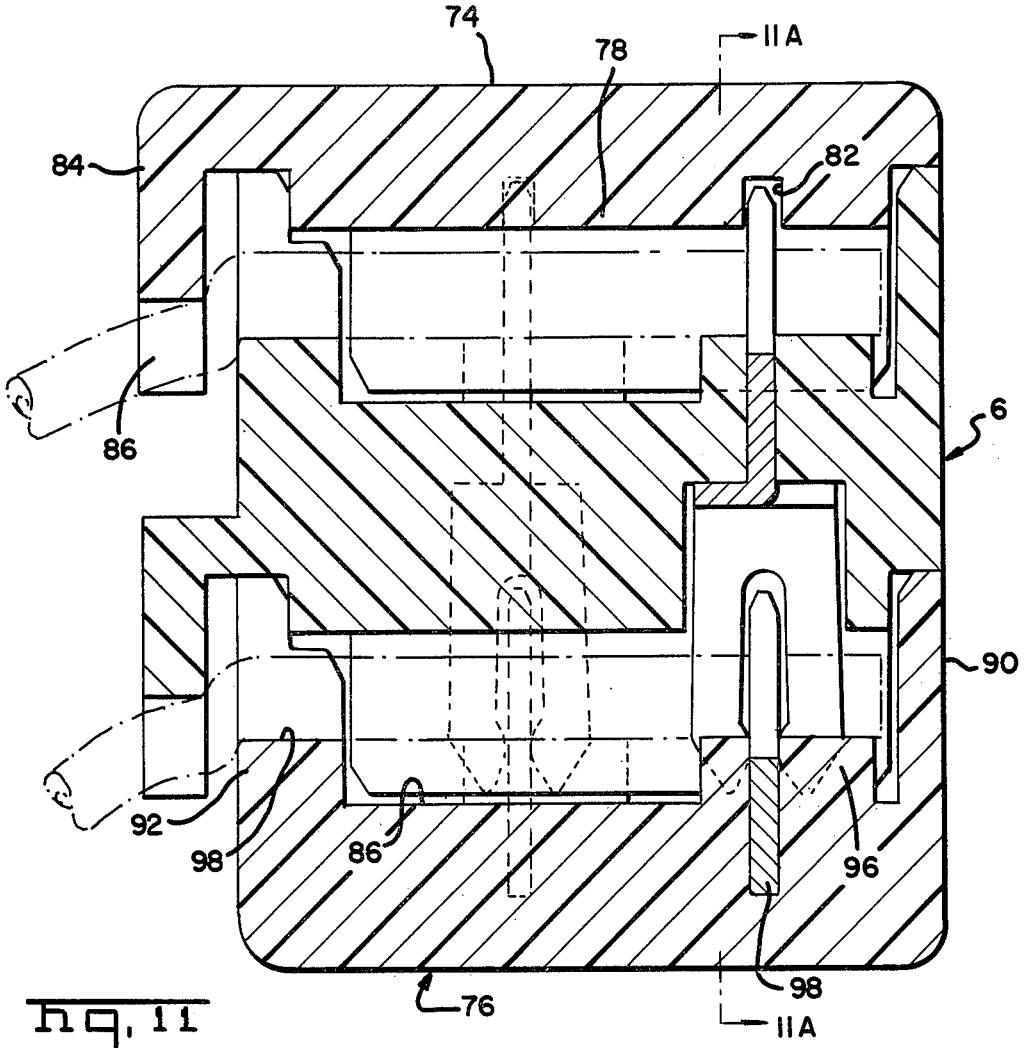
FIG. 11 is a cross sectional view of a bundle splice assembly comprising a connector body and base and cover members.

FIGS. 8 and 9 show the cover member 74, and the base member 76 which are used with the body member 6 when it is desired to splice the wires of two bundles in the most compact manner obtainable. The cover 74 comprises a generally rectangular molding 78 which is recessed along its sides as shown at 79 so that it can be fitted into the upwardly facing face of the body member 6 as shown in FIG. 11. This cover member has transversely extending flutes 80 which provide clearance for the wires and it is recessed as shown at 82 to provide clearance for the upper ends of the wire-receiving terminals in the body member 6. The cover member also has an offset depending flange 84 having notches 86 in its lower edge which provide the strain relief function previously described.

The base member 76 has an internal surface 78 which is surrounded by sidewalls 90, 92 and end walls 94. The surface 86 is provided with bosses 96 which are similar to the previously described bosses 54 in the body member 6 and the terminals 98 extend through these bosses and into the body of the base member. The terminals are simple plate-like members in this instance having upper wire-receiving portions which conform dimensionally to the wire-receiving portions 34 of the terminals 32. Base 76 is, of course, designed to be plugged against the face 10 of a body member 6 and has an upwardly extending sidewall 92 which is provided with notches 98 for cooperation with the notches 66 in the body member. These notches provide the strain relief function previously described.

Figure 12:
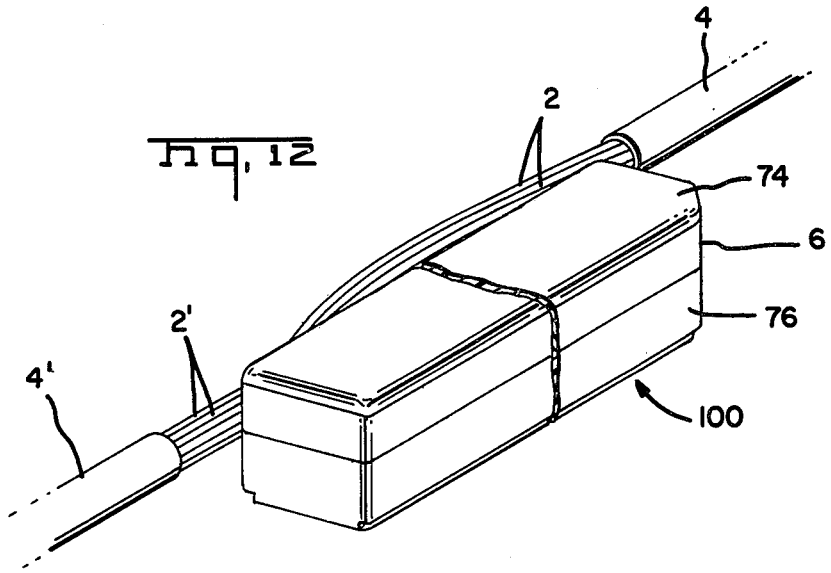
FIG. 12 is a perspective view of the connector assembly of FIG. 11.
Figure 13:
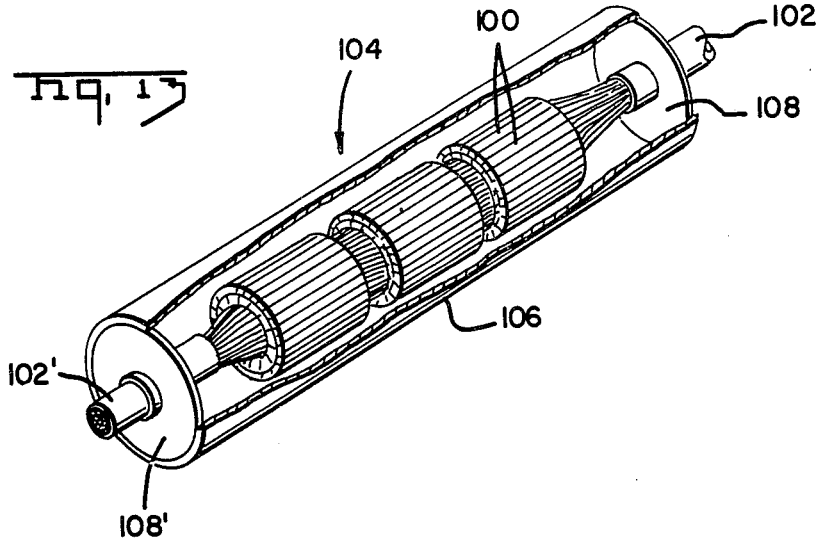
FIG. 13 is a perspective view, with parts broken away, of a splice between two multi-conductor cables in which the bundles in the cables are connected by means of a plurality of connector assemblies of the type shown in FIG. 12.

FIG. 12 shows a completed and assembled splice assembly 100 comprising a base member 76, a body member 6, and a cover member 74. The wires 2 of the cable 4 are connected to the wire 2' of the cable 4' by means of this connector assembly with the wires 2 extending into the body member and the wires 2' extending into the terminals 97 in the base member 76.

The connector assembly permits the achievement of a connector module for a standard wire bundle containing twenty-five pairs of wires in a minimum amount of space. For example, the preferred form of connector assembly 100 in accordance with the invention has a length of about 5.3 inches, a height of about 0.58 inches, and a width of 0.58 inches. These minimum dimensions are achieved by virtue of the fact that the cover member 74 and the base member 76 are of minimum thickness consistent with the achievement of good dielectric characteristics. The minimum length is achieved, in part, by the fact that the terminals overlap each other, the terminals of each row extending beyond the terminals of the achievement row on the first face 8 as is apparent from an inspection of FIG. 5.

A splice assembly of the type shown in FIG. 12 will ordinarily be used when it is necessary to connect or splice the end of a first cable 102 to the end of an adjacent cable 102'. In this field, each cable will have a plurality of twenty-five pair of bundles and a connector assembly 100 is required for each bundle splice. After all of the bundles in the cables have been connected to each other by means of individual connector assemblies 100, the entire splice containing all of the assemblies is enclosed in a splice closure 104 which has a cylindrical envelope or cover 106 and circular end plates 108, 108'. Standard specifications which are followed in the telephone industry dictate that such splice closures should have a length of no more than 19 inches from cable sheath to cable sheath. The connector assembly in accordance with the invention permits the placement of three circumferential stacks of assemblies 100 in this limited space.

Figure 14:
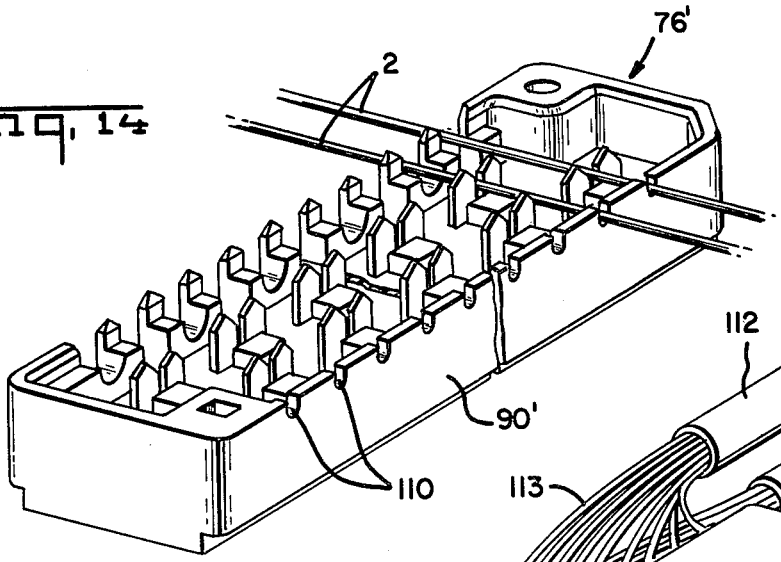
FIG. 14 is a perspective view of a modified form of base member which is used to make a tap connection to a wire bundle.
Figure 15:
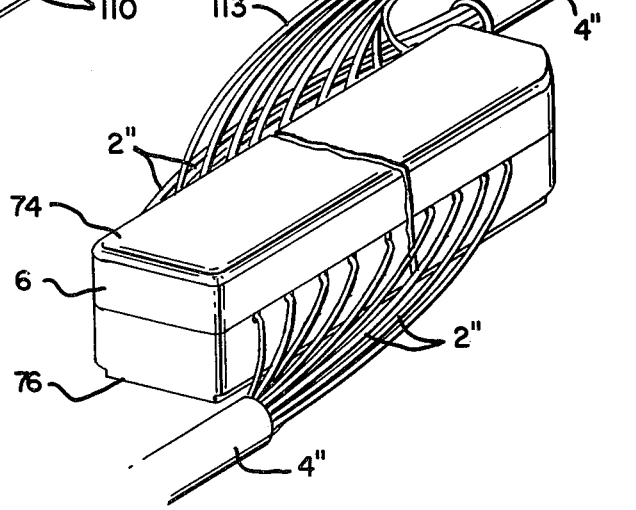
FIG. 15 is a perspective view of a tap connection to a wire bundle in which the connections are made by an assembly including the base member of FIG. 14.

FIGS. 14 and 15 illustrate the manner of connecting a branch cable 112 to a pre-existing through cable 4'', both of these cables comprising a single bundle of wires 113 and 2''. A branch of tap connections can be made without interruption to serve in the cable 4'' by substituting an alternative base member 76' for the base member 76 previously described. The base member 76' differs from the base member 76 only in that the sidewall 90' has notches 110 extending into its upper edge which are in alignment with the individual terminals. The wires 2'' of the cable 4'' are connected to the terminals by simply removing the sheath from a portion of the cable and inserting the individual wires into the terminals without cutting the wires so that they emerge through the notches 110 in the base. This operation of inserting the wires 2'' can be carried out with a tool of the type shown in U.S. Pat. No. 3,972,101 by removing the cutter bar from the tool which ordinarily trims the wires prior to inserting the wires.

The wires 113 of the cable 112 are inserted into the terminals 32 of a body member 6 of the type shown in FIG. 1 and this body member is then plugged to the base member 76' so that the tap wires 113 are connected to the proper wires 2'' in the cable 4''. The installation of a body member on the end of the cable 112 can, if desired, be carried out in a factory or a service installation rather than in the field so that the technician need only prepare the cable 4'' at the work site and plug the connector parts together.

It should be mentioned at this point that when a new telephone line is being installed, the connector parts, the body member 6, and the base member 76 can be installed on the end of the cable in a factory and after the cable is transported to the field and installed in underground conduits or on telephone poles, the cable ends can be spliced by simply plugging the connector parts to each other at the end of each cable section.

Figure 16:
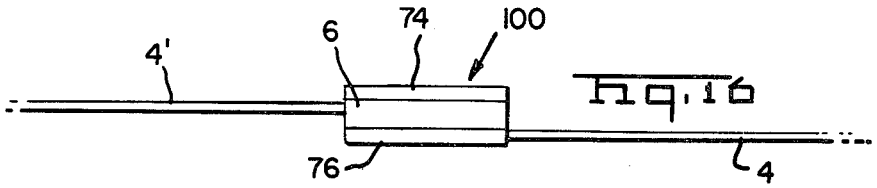
FIGS. 16–27 are a series of diagrammatic views which illustrate the invention in installing and removing equipment on electrical cables.
Figure 17:
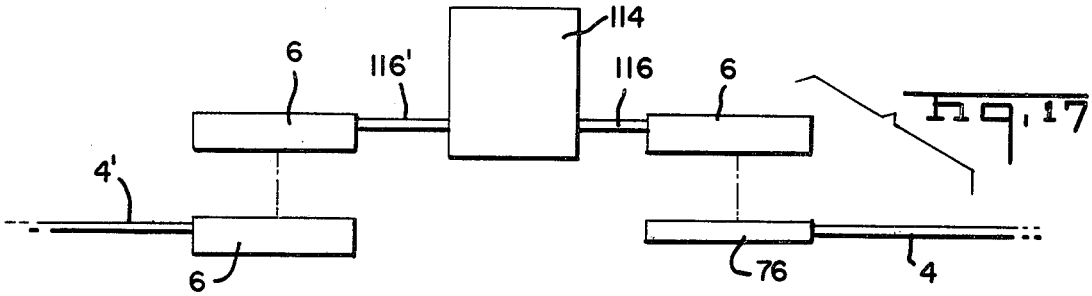
Figure 18:
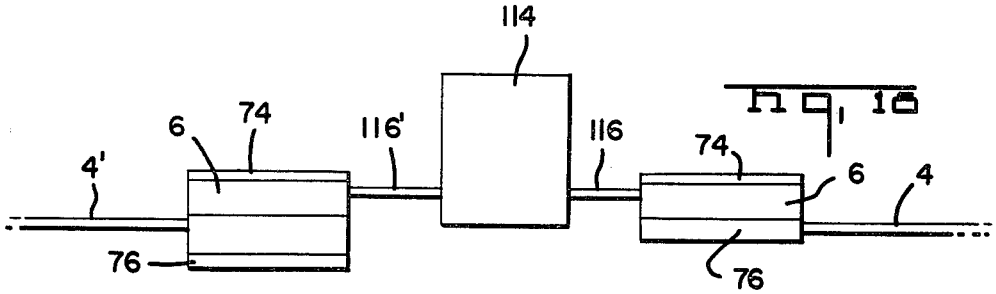

FIGS. 16 and 17 show diagrammatically the manner in which additional equipment 114 can be placed in series in a cable 4, 4' containing a splice assembly 100. The additional equipment 114 may be in the form of a load coil or the like which is ordinarily supplied with stub bundles of wires 116, 116' extending therefrom. Ordinarily, these wires would be connected in the cable in the field by any of the known prior art methods. In accordance with the invention, however, the wires 116, 116' can be provided with connector bodies 6 on their ends so that when the equipment 114 is installed, it is merely necessary to unplug or disassemble the parts 74, 6, 76 of the splice assembly 100, plug the part 6 on the cable 4' to the body member 6 on the cable 116', plug the body member 6 on the stop cable 116 to the base member 76 on the cable section 74, and assembly cap members 74 to both of the splices. The installation of the additional equipment 114 thus requires only some simple plugging and unplugging operations and the equipment 114 can be removed at a later time by following reverse procedures and reassembling the connector assembly 100 of FIG. 16.

Figure 19:
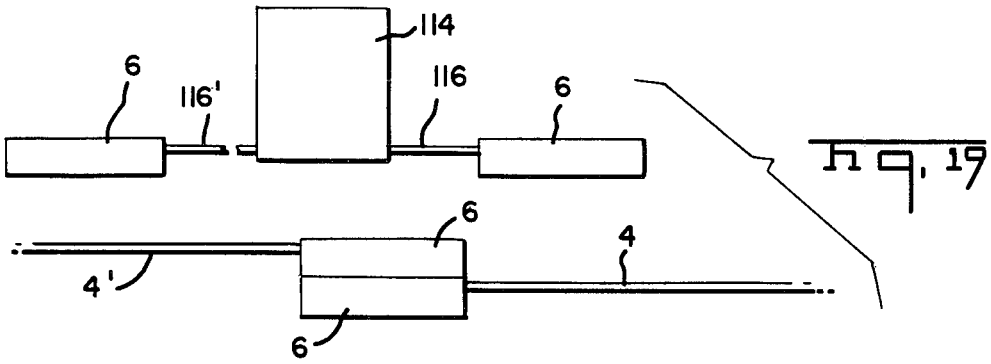
Figure 20:
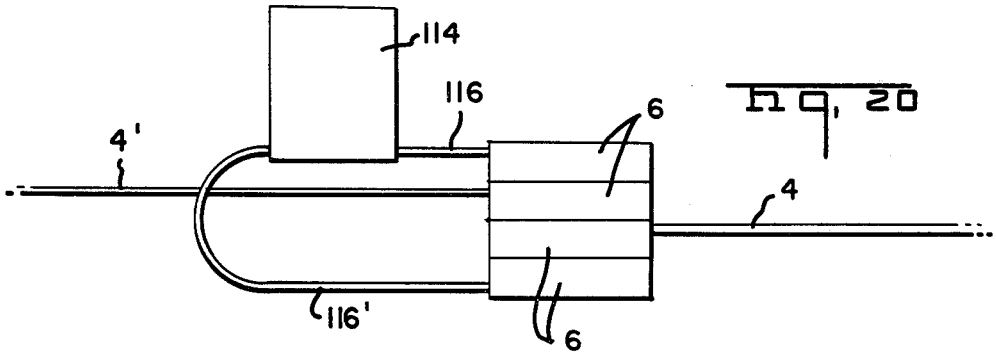
Figure 21:
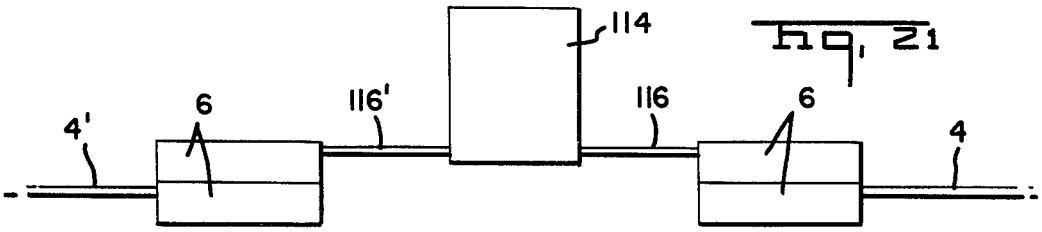

FIGS. 19–21 show an alternative method of installing additional equipment 114 which is accomplished without any interruption of service in the cable 4,4'. In this instance, the ends of the cable 4, 4' are spliced by main body members 6 which are plugged to each other. As before, the additional equipment has main body members 6 on its cables 116, 116'. In order to install this equipment without interruption of service in the cable 4, 4', the connector bodies 6 on the cables 116, 116' are plugged to the connector bodies on the ends of the cables 4, 4' as shown in FIG. 20. At this stage, the additional equipment is in parallel with the conductors in the cables 4, 4'. Thereafter, the connector bodies 6 which are on the ends of the cables 4, 4' are unplugged from each other while they remain plugged to the identical connector bodies 6 on the cables 116, 116'. The additional equipment is now in series with the conductors in the cables 4, 4'.

Such additional equipment is referred to by the telephone industry as a "two terminal network", presumably because of the two cables 116, 116' which are called "stubs". A typical two terminal network can be in the specific form of a load coil on test equipment on a "carrier" to be connected in series with the cables 4,4'. The use of stackable connectors allow versatility in joining different parts of a cable system in separate segments and at different geographical locations. That is, any desired type of two terminal network components can be joined in the system. Mistakes can be corrected or substitutions made by entering the cable system anywhere between two stackable connectors which are joined to ends of cable sections or mated together or joined to opposite ends of a two terminal network.

Figure 22:
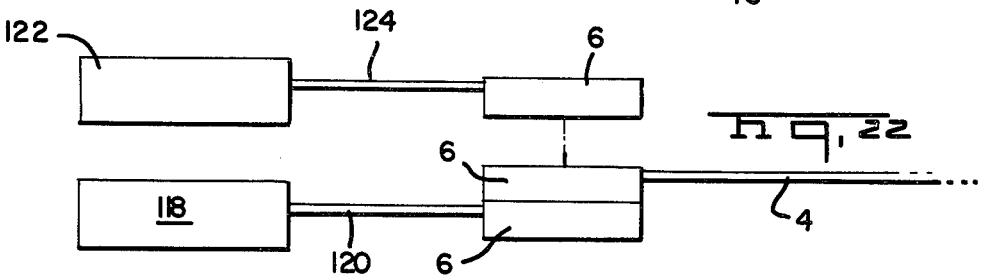
Figure 23:
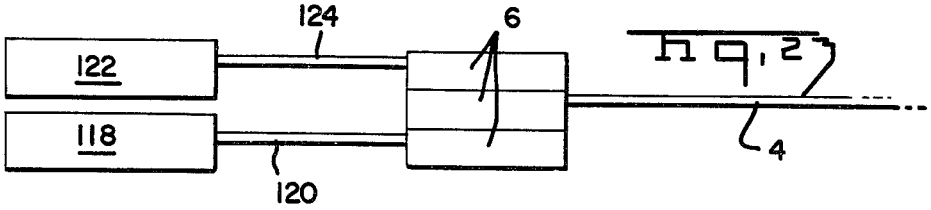
Figure 24:
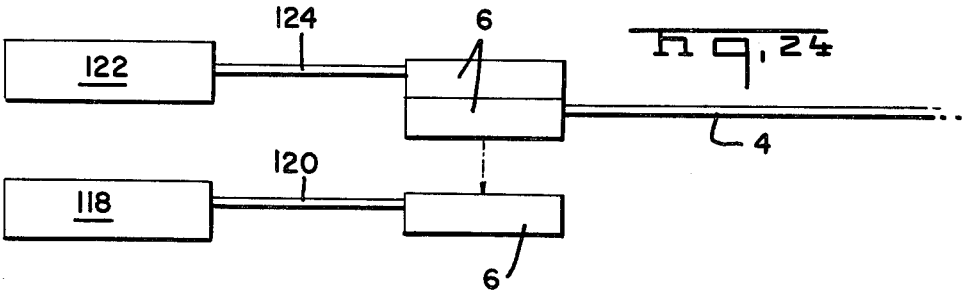

FIGS. 22–24 illustrate the use of the invention under circumstances where a cable 4 having a body member 6 on its end is connected through the body member to a body member 6 on the end of a cable extending from equipment 118 which, in this instance, can be assumed to be a cross bar switch. The older cross bar switches are being replaced in many parts of the telephone system by electronic switching systems diagrammatically indicated at 122 in FIG. 19. The electronic switching system 122 can be placed in service without interruption of service in the cable 4 by providing a body member 6 on the ends of the conductors 124 which extend from the electronic switching system 122. The installation of body member 6 on cable 124 would be carried out in the factory and the switching system transported to the site of installation. The body member 6 on the cable 124 is plugged into the upper face of the body member 6 on the cable 4, FIG. 23, so that both of the switching systems would be plugged into the line 4 for a brief interval. Thereafter, the body member 6 on the cable 120 is unplugged from the lower face of the body member on cable 4 leaving only the electronic switching system 122 in the system. This conversion from a cross bar switching system to an electronic switching system is referred to as a "central office cutover", a procedure which is simplified and accomplished without service interruption when practiced according to the invention.

The cross bar switch 118 in FIG. 24 can be put to further use and since it has a body member 6 on its conductors 120, it can be installed at a different location by merely plugging it into the system. A changeover of this type might take place, for example, when a cross bar switch is replaced by an electronic switching system in an important application and the cross bar switch is later used in a different system such as a PBX system. The cross bar switch is readily incorporated into the PBX system without modification since the attached body members 6 organize the multiple wires for plugging correctly into the system.

Figure 25:
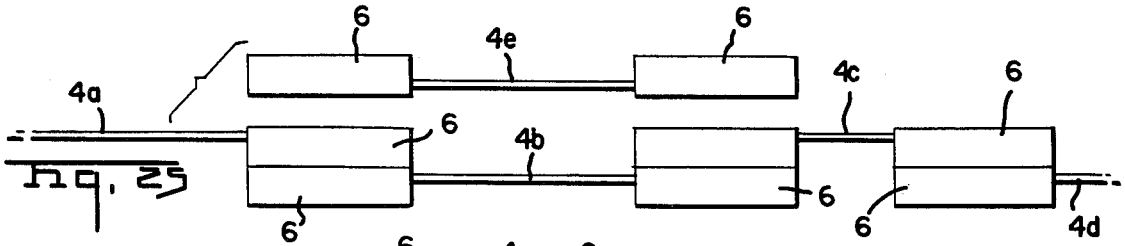
Figure 26:
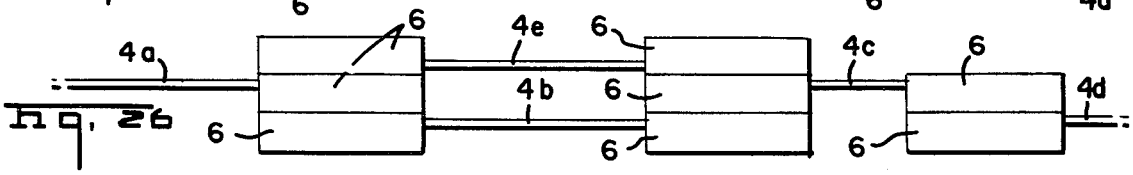
Figure 27:
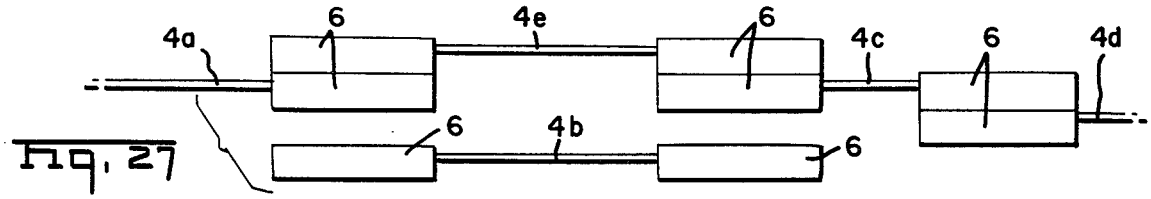

FIGS. 25–27 illustrate the manner in which a deflective cable section can be replaced without interruption of service in the entire cable. In FIG. 25, a continuous cable comprises cable sections *4a*, *4b*, *4c*, and *4d*, the ends of the cable sections in all instances being connected or spliced by connector bodies 6. If the cable section *4b* is defective, for example, if the insulation on the wires is deteriorated so that it is "noisy", it can be replaced by a new section of cable *4e* which is of the same length as section *4b* and which also has connector bodies 6 on its ends. The connector bodies on the ends of cable section *4e* are simply plugged to the upper faces as viewed in FIG. 25 of the bodies 6 on cable sections *4a* and *4c* as shown in FIG. 26. Sections *4b* and *4e* are now in parallel and section *4b* can be removed as shown in FIG. 27 to return the cable to its original condition.

Figure 28:
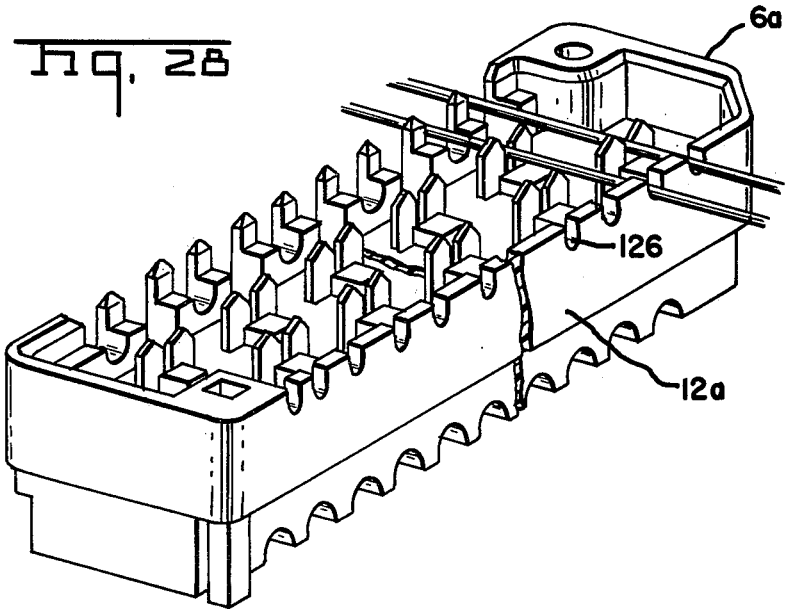
FIG. 28 shows an alternative embodiment.

It will be apparent that a wide variety of cable modifications and changes can be made by the use of the body section 6 without any interruption in the service in the cable to which the equipment is being added or the changes being made. FIGS. 19–27 illustrate changes which can be made when the ends of the cable sections are terminated with either connector bodies 6 or, as shown in FIG. 16, a connector body 6 and a base section or body 76. It will be apparent from FIGS. 19–27 that the connector body 6 offers more options for cable changes than does the base section for the reason that the body 6 can receive an identical body at both of its faces. It may be desirable to use a base section of the type shown at 76', FIG. 14, for making some changes in the circuit and under other circumstances it would be desirable to have a connector body as shown at *6a*, FIG. 28. Connector body *6a* can be identical to connector body 6 except that it has notches 126 in the upper edge of sidewall *12a*. The connector body *6a* can thus be installed on a bundle of wires or a cable without interruption of service and it can, like the connector body 6, receive two identical connector bodies, again without interruption of service. The use of a connector body of the type shown in FIG. 28 will thus expand the number and types of circuit modifications which can be carried out without interruption of any of the circuits.

FIGS. 22 and 23 also are illustrative of another cable modification, that of making a "Y" joint without service interruption. In the telephone industry there exists a requirement to reroute an existing cable in service by dividing the cable into two or more branches extending in different directions from the direction of the existing cable. This can be done by the present invention, referring to FIG. 22, which illustrates an existing cable comprised of sections 4 and 120, connected in series by the connector bodies 6. To branch the existing cable, a procedure known in the telephone industry as adding a bridge, heretofore required a large number of connections to be made by workmen at the site of the desired branch. Service interruption was also required while making the connections. According to the present invention, the connector bodies 6 are interconnected merely by stacking one on the other. Accordingly, workmen need only possess a cable section 124 provided with a connector body 6 at one end and a connector body 122 at the other end. This cable section can be preassembled at a remote workbench or factory site. The preassembled cable section need only be connected by stackably interconnecting connector bodies 6 as shown in FIG. 23, without interruption of service over the existing cable sections 4 and 120. The cable section 4 thereby branches into two cable sections 120 and 124 which can be extended independently of each other by additional cable connections made at connector bodies 118 and 122. The connector bodies 118 and 122 are illustrative of any kind of connector body similar to or different from connector bodies 6.

The electrical contact terminals, FIGS. 3 and 4, used in the practice of the invention have several advantages which render them particularly suited for use in the connector assembly. As previously mentioned, each terminal 32 is formed by stamping and forming operations as a single piece which is assembled to the body member by merely inserting the upper plate-like member 38 through an opening in the body member. The lower portion of the terminal, the receptacle portion 36, has a self-contained spring system by means of which electrical contact is established between the contact portions 50 of the receptacle portion of one terminal and the plate-like conductor-receiving portion 38 of another terminal as shown in FIG. 4. In other words, the mated terminal devices of FIG. 4 do not require any external support for the maintenance of electrical contact between the terminals. This feature is of importance in the practice of the instant invention for the reason that the terminals in the intermediate body member are on closely spaced centers and there is not a large volume of insulating housing material serving to support the terminals; the terminals are entirely self-contained in a mechanical and electrical sense.

What is claimed is:

1. A method for incorporating electrical equipment into a multiconductor transmission line cable having cable sections serially connected by stackable electrical connectors having wire-receiving electrical terminals which become interconnected when said connectors are stacked one on the other, the steps comprising:

connecting one of said stackable electrical connectors to an input cable of said electrical equipment, connecting a second of said stackable electrical connectors to an output cable of said electrical equipment, stacking said one of said stackable electrical connectors to a first pair of stackable connectors which serially connect one of said cable sections in said transmission line, stacking said second stackable electrical connectors to a second pair of stackable connectors which serially connect said one of said cable sections in said transmission line, thereby connecting said electrical equipment electrically in parallel with said one of said cable sections, and disconnecting the electrical connectors of said one of said cable sections from said transmission line leaving said electrical equipment serially connected in said transmission line.

2. In a method for installing electrical equipment electrically in series with serial lengths of transmission cable having multiple conductors terminated at opposite ends to multicontact connectors, the improvement comprising:

terminating an input multicontact connector into input conductors of said electrical equipment, terminating an output multicontact connector onto output conductors of said electrical equipment, stackably joining said input and output connectors to corresponding multicontact connectors at opposite ends of at least one of said lengths of transmission cable, thereby connecting said electrical equipment in parallel with said at least one of said lengths of transmission cable, and removing said connectors terminated to opposite ends of said one length of transmission cable leaving said electrical equipment in series with the remaining transmission line lengths.

3. The method of claim 2 wherein said one length of transmission cable includes a cross bar switch and said electrical equipment includes an electronic switching network, and wherein said improvement further comprises:

stacking and joining said input and output connectors to selected corresponding connectors of said transmission line, whereby said electronic switching network is electrically in parallel with said cross bar switch, and removing said connectors at opposite ends of said one transmission line length whereby said cross bar switch is substituted by said electronic switching network in said transmission line without interrupting service of said transmission line.

4. A method for replacing sections of multiconductor transmission cable without interrupting signal transmissions, within said sections are connected together serially with mated pairs of multicontact electrical connectors, comprising the steps of:

providing a replacement section of transmission cable with input and output multicontact electrical connectors, each of which are mateable to a mated pair of multicontact electrical connectors of said transmission cable, connecting said input and output connectors with any two mated pairs of electrical connectors of said transmission cable, whereby said replacement section is electrically in parallel with said transmission cable, and disconnecting a related section of said transmission cable which is in parallel with said replacement section, leaving said replacement section in series with said transmission line.

* * * * *